US007146996B1

(12) United States Patent
Shires

(10) Patent No.: US 7,146,996 B1
(45) **Date of Patent: *Dec. 12, 2006**

(54) LIGHTWEIGHT SHELTER

(76) Inventor: Henry C. Shires, 330 Belmont Ave., Redwood City, CA (US) 94061

( * ) Notice: Subject to any disclaimer, the term of this patent is extended or adjusted under 35 U.S.C. 154(b) by 445 days.

This patent is subject to a terminal disclaimer.

(21) Appl. No.: 10/673,285

(22) Filed: Sep. 30, 2003

(51) Int. Cl.
*E04H 15/36* (2006.01)
*E04H 15/58* (2006.01)

(52) U.S. Cl. ..... 135/126; 135/125; 135/128; 135/136; 135/117; 135/87

(58) Field of Classification Search ..... 135/87, 135/90, 124, 117, 123, 125, 126, 128, 136
See application file for complete search history.

(56) References Cited

U.S. PATENT DOCUMENTS

| | | | | | |
|---|---|---|---|---|---|
| 785,582 | A * | 3/1905 | Stempel | 135/90 |
| 1,057,628 | A * | 4/1913 | Eberhardt | 135/97 |
| 1,215,139 | A * | 2/1917 | Gail | 2/89 |
| 2,258,084 | A * | 10/1941 | Baker | 135/97 |
| 2,263,867 | A * | 11/1941 | Barnard | 135/90 |
| 2,567,697 | A * | 9/1951 | Craighead, Jr. et al. | 135/90 |
| 2,741,224 | A * | 4/1956 | Putnam | 119/718 |
| 3,060,949 | A * | 10/1962 | Moss | 135/87 |
| 3,240,217 | A * | 3/1966 | Bird et al. | 135/123 |
| 3,970,096 | A * | 7/1976 | Nicolai | 135/94 |
| 4,198,997 | A * | 4/1980 | Miller | 135/90 |
| 4,605,029 | A * | 8/1986 | Russell | 135/125 |
| 4,719,934 | A | 1/1988 | Mydans | |
| 4,719,935 | A * | 1/1988 | Gustafson | 135/124 |
| 4,757,832 | A * | 7/1988 | Russell | 135/128 |
| 5,915,400 | A * | 6/1999 | Pohl et al. | 135/125 |
| 6,742,533 | B1 * | 6/2004 | Olson | 135/95 |
| 2001/0042563 | A1 | 11/2001 | Coupounas | |
| 2003/0221716 | A1 * | 12/2003 | Olson | 135/95 |

OTHER PUBLICATIONS 6 pages from http://web.archive.org/web/20020806151027/www.tarptent.com, Aug. 2, 2002.*
Shires, Ultralight Shelters (About Tarptent), webpage, 2003 (referring to 1999 and 2002 products), 2 pages.
Shires, Ultralight Shelters (Henry's Original Tarptent and Tarptent-for-2), webpage article, last update Sep. 5, 2001, 19 pages.

* cited by examiner

*Primary Examiner*—Robert Canfield
(74) *Attorney, Agent, or Firm*—Northern Michigan Patent Law, PLC

(57) ABSTRACT

A nominally floorless hikers' shelter having a raised, tensioned waterproof canopy supported off the ground by pole supports at the front and rear, in which the canopy has a catenary curved ridgeline tensioned between a higher vertical front support and a lower, outwardly-angled rear arch support. The shelter preferably has a hanging insect netting perimeter, including front and rear door panels and sidewalls, and floor-ready attachment structure for an optional floor to be attached to the support structure in the sleeping area defined by the netting without placing stress on the netting. In a first form the vertical front support is a straight pole; in a second form the vertical front support is a vertical arch. A multiple guyline/single-stake structure for guying out a tensioned shelter edge is also disclosed.

10 Claims, 10 Drawing Sheets

LIGHTWEIGHT SHELTER

FIELD OF THE INVENTION

The present invention is in the field of tent and tarp type shelters used by hikers and campers.

BACKGROUND OF THE INVENTION

Hikers and campers, especially backpackers, usually require a shelter such as a tent for overnight or multi-night trips. The longer the trip, the greater the need for a shelter of as little packed weight as possible to reduce fatigue, to make room for food and other gear, and to increase the enjoyment of hiking.

Tents tend to be one of the heaviest items in the pack, and many hikers opt for lighter, less-protective tarps or floorless shelters such as nylon pyramids for the weight savings alone. Even "single-wall" tents, with only one layer of waterproof canopy fabric (rather than spaced layers of breathable and waterproof fabric), tend to be heavier than tarps due to the tents' flooring and heavier structural components. Moreover, single-wall tents tend to be known for condensation problems, where exhaled and evaporated moisture from the occupants condenses on the inner surface of the fabric and either drips or runs down the walls onto the floor. Solutions to the condensation problem such as inner wicking surfaces and vents tend to increase weight, and have limits in certain environmental conditions.

Other factors in choosing a tarp shelter over a tent seem to be the preference among many hikers for a more open, airy, close-to-nature experience while sheltering and sleeping outdoors, and the absence of any need to care for an attached floor and keep it clean. The primary drawbacks of tarp shelters are their lack of structural stability in wind, and their lack of insect protection as they are typically floorless and without insect netting.

A hybrid solution to the foregoing problems has been to apply netting in some fashion to tarp style shelters, with mixed success. Detachable netting inserts, defining floored or floorless screened enclosures within the protective tarp canopy, tend to add undesirable weight back into the system. Fixed netting sewn along the tarp perimeter and hanging to the ground provides some protection, but the lack of tensioning and supporting structure in even a well-rigged tarp mitigates some of the benefit. And, finally, tarps simply lack the tent-like structural strength and protection that many hikers find preferable.

An early solution to the foregoing problems was my original Tarptent™ shelter. This combined features of tarps and tents, with a pole-supported, tensioned, tent-style waterproof canopy using lightweight material, and front and rear doors and a sidewall made from insect netting to reduce condensation and provide bug protection.

A second version of the Tarptent™ shelter offered improved structural strength and ventilation using a waterproof canopy raised fully off the ground, a catenary curved ridgeline, and a tensioned, inwardly-angled rear arch pole in place of the previous upright rear pole. The rear arch was staked out with a single stake anchoring three tensioned guylines running from a rear arch awning.

The Tarptent™ shelters were primarily intended as floorless shelters for simplicity and weight savings, with lightweight, removable groundcloths preferably used over the bare-ground "footprint" bounded by the drop-down netting sidewalls and front and rear netting panels. Floors, however, can be optionally added by sewing them to the hanging netting perimeter along the sides and rear.

BRIEF SUMMARY OF THE INVENTION

The invention is an improved structure for nominally floorless canopy shelters, the improved structure including a canopy with a lower, outwardly-angled rear arch support tensioning a catenary ridgeline against a higher, vertical front support. By "nominally floorless" is meant shelters with a raised-off-the-ground, tensioned canopy structure where a floor is either absent, or is attached to but is not structurally a part of the raised, tensioned canopy structure as a whole.

In a first form of the invention the higher, vertical front support is a straight pole. In an alternate form the vertical front support is an arch.

In a further form the invention is an improved guyline arrangement for a raised, tensioned shelter edge, such as the rear arch or its awning, in which a central guyline extending from a center portion of the tensioned shelter edge is secured to an outer guyline extending between two outer anchor points on the tensioned shelter edge. The central guyline can be anchored to a single stake in a manner that simultaneously tensions the outer guyline, and that allows tension to be adjusted across the shelter edge with the central guyline.

In a further form the invention is a floor-ready attachment structure anchored to the support structure for the tensioned canopy portion of the shelter, allowing an optional floor to be securely attached to the netting perimeter of a standard floorless shelter without placing stress on the netting. In a further form the floor-ready attachment structure provides forward-tensioning of an added floor to reduce shifting and bunching of the floor while sleeping or entering/exiting the shelter.

In yet a further form the invention is an improved front awning structure for the front door, where the awning is coextensive with the front edge of the canopy, and in its extended state is releasably tensioned to the front guyline.

These and other features and advantages of the invention will become apparent from further reading of the specification in light of the accompanying drawings.

DETAILED DESCRIPTION OF THE INVENTION

Figure 1:
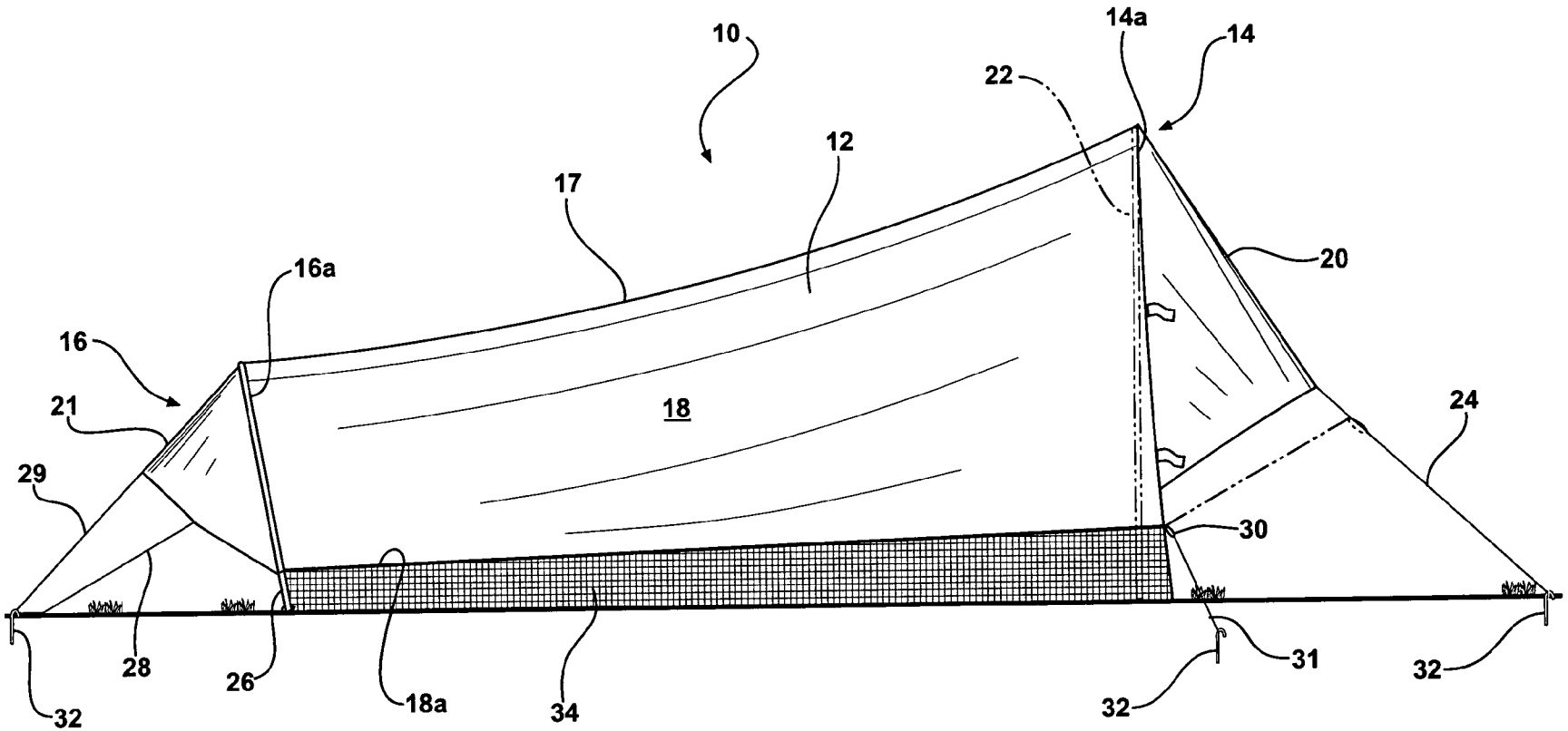
FIG. 1 is a side elevation view of a shelter according to the present invention.

Referring first to FIG. 1, a shelter 10 according to the invention has a waterproof canopy 12 made from a lightweight material commonly used for tents and tarps such as coated or treated nylon or polyester. While a waterproof material is preferred for such shelters, it will be understood by those skilled in the art that the degree of waterproofness can vary, and that for some uses water-resistant, wind-resistant, or sun-blocking materials that are not fully waterproof may be useful. The term "waterproof" will be used to include both waterproof and other weather-protective materials useful for such shelters. In the illustrated embodiment the canopy material is a lightweight siliconized nylon of known type, weighing less than two ounces per square yard.

Shelter 10 has a front end 14 defined generally by front edge 14*a* of canopy 12, a rear end 16 generally defined by rear canopy edge 16*a*, a ridgeline 17, sidewalls 18 ending at canopy side edges 18*a*, a front awning or beak 20, and a rear awning or beak 21. The front and rear awnings are preferably made from the same material as canopy 12.

The front end of the canopy is raised and tensioned at the peak of ridgeline 17 on a vertical support 22, the tip of the support resting for example in a grommet or a reinforced pocket of canopy 12. The rear end of the canopy is raised and tensioned on a cantilevered arch support 26 centered at the ridgeline. Canopy tension and structure are maintained by guying out the front and rear supports 22 and 26, in the illustrated embodiment with a guyline 24 secured at or near the tip of support 22 at the front, with multiple guylines 28, 29 at the rear, and with a guyline attached to a loop or pullout point 30 at each lower front corner of canopy 12. The guylines are preferably secured to the ground with stakes 32, although they can also be secured to shrubs, trees, rocks and other available anchor points in known manner.

In the illustrated embodiment, vertical support 22 and rear arch 26 are lightweight, hollow, flexible aluminum poles of a type commonly used for tents, preferably collapsible into joined sections for compact carry. Rear arch pole 26 may be formed with some or all of its sections pre-curved. It will be understood that other materials and structures can be used for the front and/or rear supports, one known alternative being fiber-resin composite rods or poles, although hollow aluminum poles are currently believed to be the most practical and economical.

Once canopy 12 is supported and tensioned on poles 22 and 26, it forms a stable, taut, floorless shelter structure with its front, rear, and side edges raised off the ground. The falling catenary ridgeline 17, dropping from the canopy's peak at front end 14 to the lower, rearwardly-angled arch at rear end 16, causes the ridgeline and sidewalls to be evenly tensioned and essentially wrinkle-free, giving the shelter strength, sag resistance, and wind-shedding ability. Canopy 12 therefore floats above the ground with stability more like that of a tent or a rigid structure than a tarp. Ridgeline 17 is a true catenary curve, defined by the well-known hyperbolic catenary curve equation created to describe the curve naturally taken by a homogeneous cable suspended by its ends. Unlike many tarp shelters, the side edges preferably run straight, offering better weather protection and in most conditions not needing additional staking for stability. For high side winds, one or more extra pullout points or guylines can be spaced along canopy side edges 18*a* and used as needed.

The spacing of canopy 12 above the ground when properly erected can vary. In the illustrated embodiment the preferred spacing of the sidewall edges from the ground is about eight inches. The peak height at the front end in the illustrated embodiment is about 42" (inches), at the apex of the rear arch about 21.5" (inches). The width of the illustrated shelter in front is about 80" (inches), at the rear arch about 51" (inches), and the overall length is about 93" (inches). It will be understood that these dimensions are for the particular two-man ultralight model shown in the illustrated embodiment, and that they can vary relative to one another or overall, depending on the desired size of the shelter, the premium placed on light weight versus space and headroom, and other factors that will be recognized by those skilled in the art. The dimensions and proportions of the illustrated embodiment are preferred in part in part for function and in part for the sleek, aesthetically pleasing appearance of the shelter.

Figure 2:
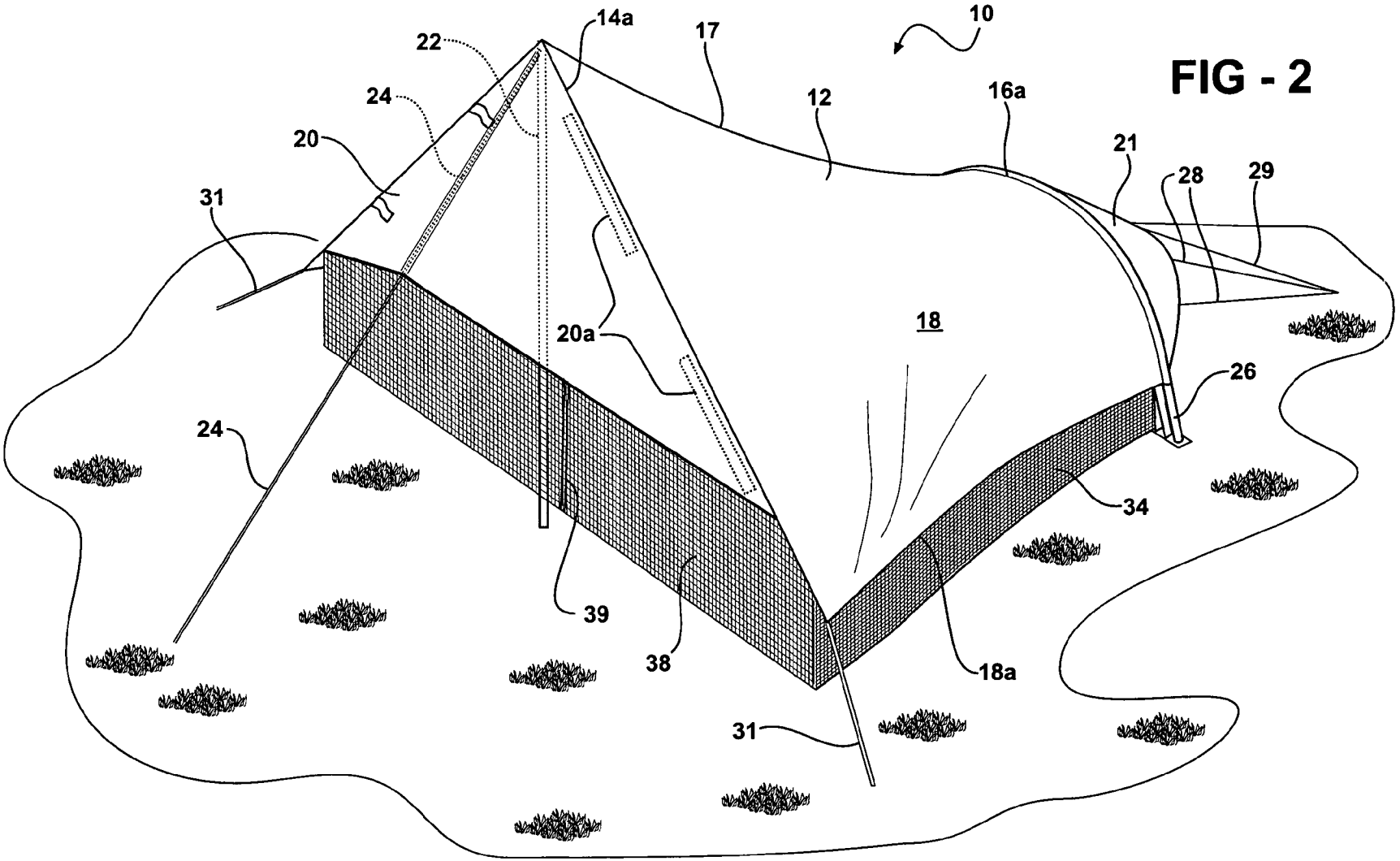
FIG. 2 is a perspective front view of the shelter of FIG. 1, with a portion of a front awning shown pulled back in phantom.
Figure 3:
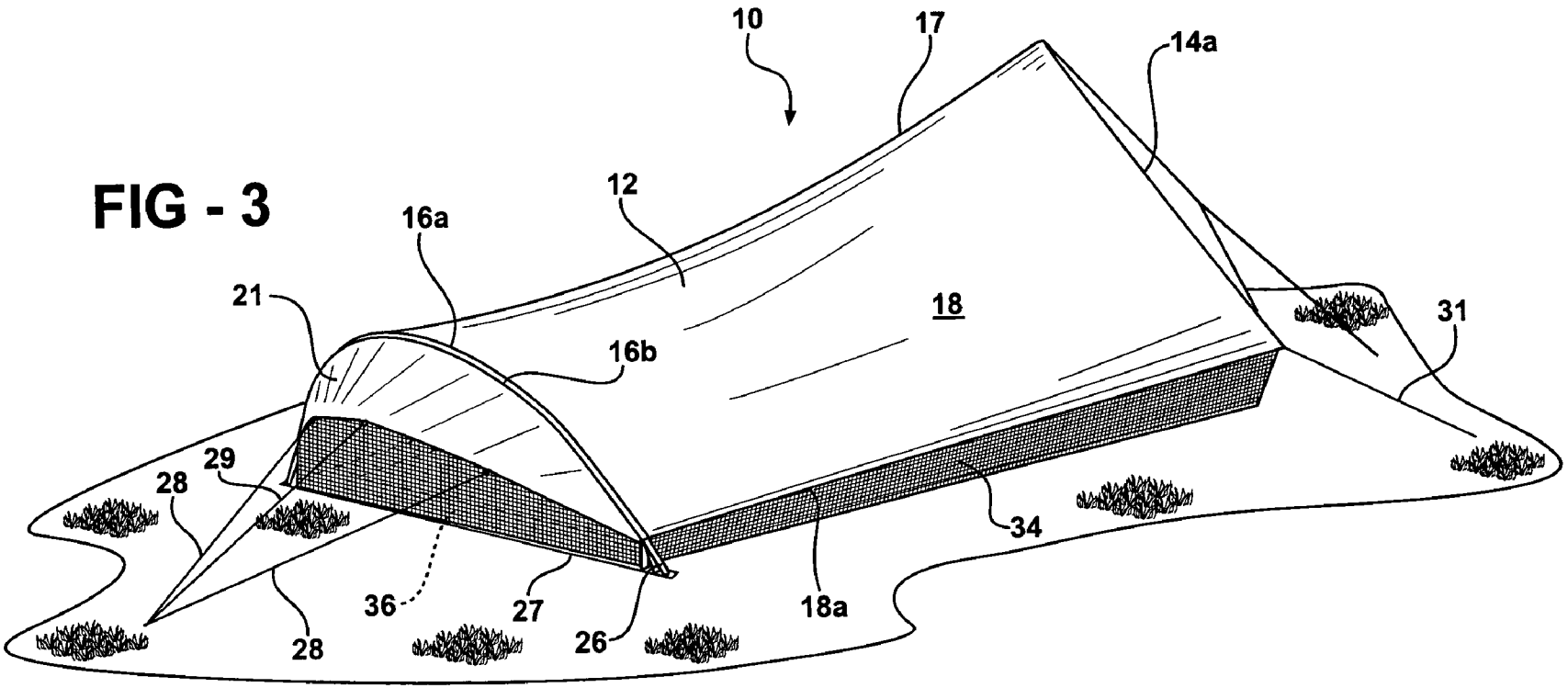
FIG. 3 is a rear perspective view of the shelter of FIG. 1.

Referring to FIGS. 1 through 3, canopy 12 is provided with a drop-down netting perimeter for insect protection, and additionally for protection against blowing rain, sand and snow. Netting sidewalls 34 hang from canopy sidewalls 18 to the ground, a netting end panel 36 (FIG. 3) hangs from rear canopy edge 16*a* to the ground, and a netting door 38 hangs from front canopy edge 14*a* to the ground. Door 38 is preferably divided or otherwise opened or parted, for example with a zipper 39 (FIG. 2) for ease of entry and exit. End panel 36 can be fashioned as a secondary door, if desired, although the low height of rear end 16 makes this less convenient. The netting is preferably attached by sewing to the front, rear, and side edges of the canopy, although other methods could be used. The netting is preferably attached at the very edges of the canopy, but could also be set back.

Shelter 10 is designed to be nominally floorless, as shown, with the ground-engaging netting perimeter defining a bare-ground footprint under the canopy (FIGS. 2 and 5) for sleeping and gear storage. The netting may be designed to hang just to the ground at an optimum canopy height, or can be provided with extra length to permit canopy height adjustment while maintaining insect protection. In the preferred embodiment illustrated, the lower edge of the netting perimeter forms a horizontal flap along the sidewalls and rear panel designed to extend inwardly on the ground for several inches to provide a place to anchor the free-hanging netting with rocks, gear, sleeping bags, stakes, and such; or to allow a removable groundcloth to be overlapped with the netting for increased insect protection; or to provide an attachment point for an optional floor.

Figure 3A:
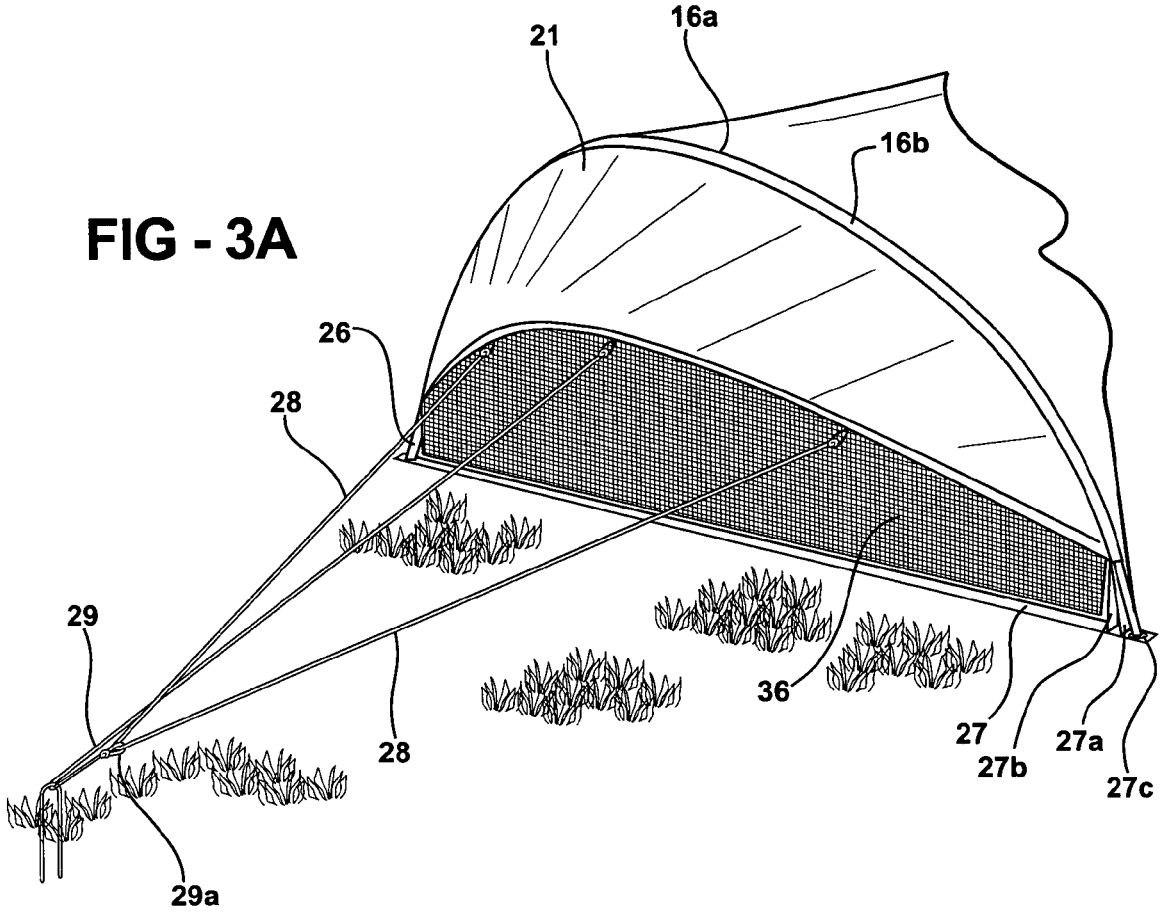
FIG. 3A is a detailed perspective view of the rear guyline arrangement.

FIGS. 3 and 3A illustrate the details of the rear arch support and awning structure, and of a novel guyline arrangement allowing three spaced guylines from a tensioned shelter edge to be staked out with a single stake in a single step. Rear edge 16*a* of canopy 12 has a pole-securing structure in the form of a continuous sleeve 16*b* for pole 26, the pole being removably inserted in the sleeve in known fashion, and long enough that its ends protrude from each end of the sleeve once inserted. A lateral tension strap 27 is spaced from and connected to the ends of the sleeve with short connector straps 27*a* (and optionally straps 27*b*), each end of tension strap 27 having a pole-receiving structure such as grommet 27*c*. When the ends of pole 26 are inserted in the grommets, the tension from the curve of the pole and the rear edge of the canopy pull strap 27 to its maximum width, locking pole 26 and the rear of the canopy into its arched structure. Vertical short connector straps 27*b* provide both a visual indicator that main strap 27 is not twisted during setup, and serves as a failsafe connection between the pole sleeve and strap 27 should the end of pole 26 come loose.

It will be understood that while a continuous pole sleeve is the preferred way to secure the pole to the canopy, other methods such as discontinuous sleeves and clips are possible.

Rear awning 21 is connected to the rear edge of the canopy, for example at sleeve 16*b* by sewing, extending along at least a major portion of the arch (and preferably coextensive with the rear end of the canopy as shown) to overlie at least a major portion of rear netting panel 36, which is connected to and hangs down from the inside of the rear edge of the canopy. Awning 21 has an acute downward angle relative to the plane of the arch. Awning 21 extends a greater distance from the canopy at its center, and is preferably tapered inwardly toward the sleeve ends on either side, generally following the sweep of the arc of pole 26. Three guylines extend from the rear edge of awning 21, converging to a single stakeout point as shown in FIG. 3.

Guylines 28 are formed by a single loop of cord secured at either end to the opposite sides of rear awning 21, and bisected by shorter, straight center guyline 29 attached to the center of awning 21 at one end and to the middle of cord 28. In the preferred embodiment illustrated, center line 29 is slidably connected to cord 28, for example with a simple knotted loop 29*a* as shown, or with a sliding clip, hook, or the like. Referring to FIG. 3A, the length of center line 29 is longer than the maximum tensioning distance from the center edge of awning 21 to the apex of the "V" of fully tensioned cord 28. Staking out and tensioning the guylines is accordingly accomplished in a single step by hooking or looping an intermediate portion of center line 29 and staking it down rearwardly beyond the sliding junction of center line 29 with cord 28, as shown. Tension can be adjusted left and right on the awning by sliding center line 29 along cord 28, and back and forth simply by moving the single stake toward or away from the tent.

It will be understood that the guyline structure 28, 29 of FIGS. 3 and 3A can be used for other tensioned shelter edges in the illustrated shelter or even in different shelters, where a raised canopy edge needs to be staked out with a minimum number of stakes and evenly tensioned along its length.

Figure 4:
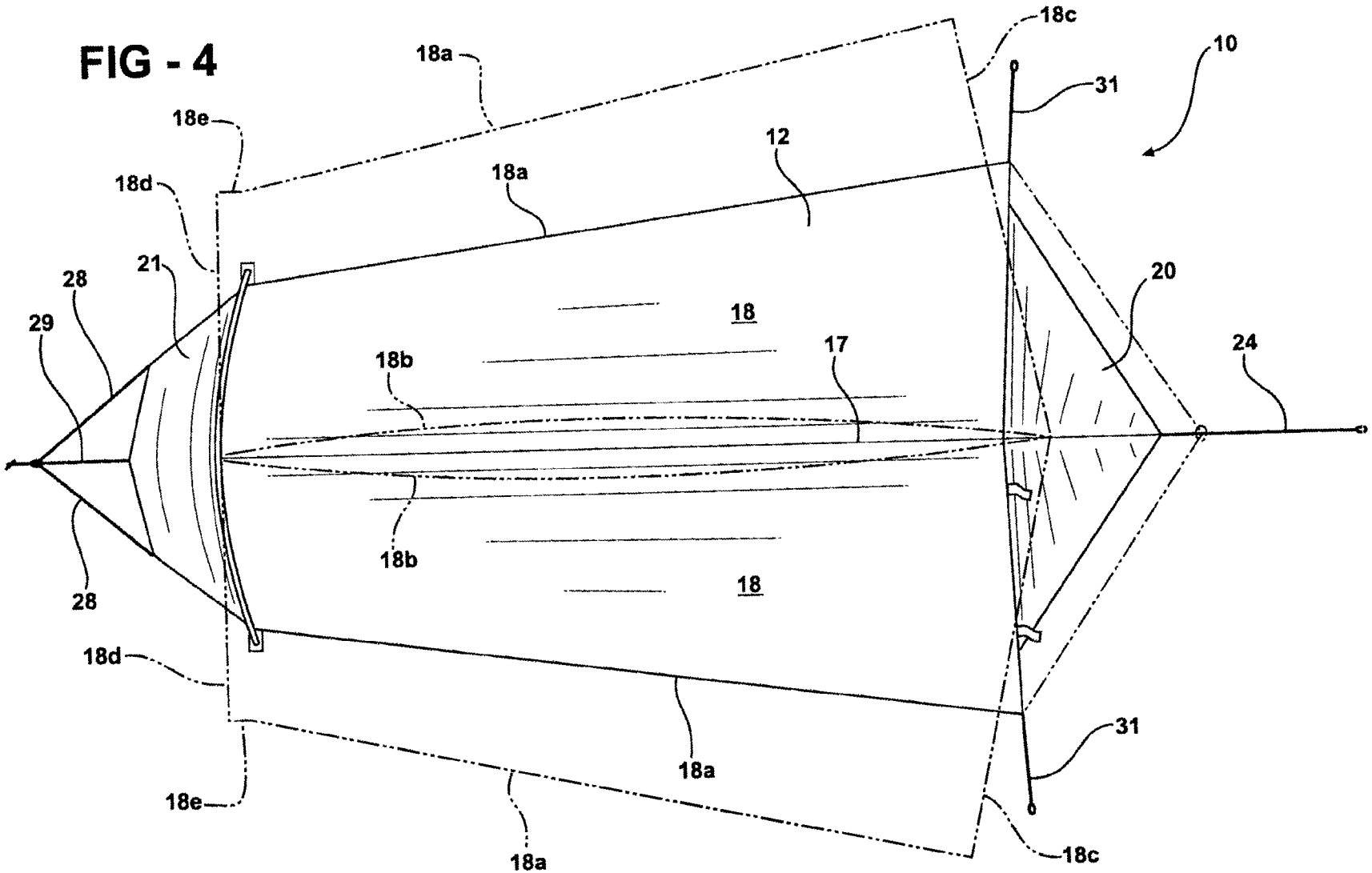
FIG. 4 is a top plan view of the shelter of FIG. 1, with the waterproof canopy pattern superimposed in phantom in its flat condition.

FIG. 4 shows the pattern for canopy 12 superimposed in phantom over the erected shelter, and in particular shows that catenary ridgeline 17 is a true ridgeline, formed by the joinder of two separate, generally trapezoidal fabric panels 18 along a center seam, in the illustrated embodiment a sewn seam. Each panel 18 has a catenary seam edge 18*b* that in the flat condition curves inwardly from the panel ends, away from the opposite panel's seam edge. The ends 18*c* and 18*d* of each panel are angled inwardly toward one another relative to seam edge 18*b*, with front ends 18*c* being essentially straight and rear ends 18*d* preferably having a mild convex curvature and a length requiring a short outwardly-angled shoulder 18*e* where side edge 18*a* joins rear end 18*d*. This configuration results in a shelter having a vertical front end and an outwardly-cantilevered rear arch when the shelter is erected with tension sufficient to make ridgeline 17 taut. This configuration also allows the rear edges 18*d* to be folded over and sewn or otherwise secured to form a straight sleeve for arched pole 26, and further allows rear awning 21 to evenly tension the canopy through the multiple guyline arrangement shown in FIGS. 3 and 3A. The preferred angle for the rear arch in the illustrated embodiment is about 12° (degrees) from vertical. It will be understood by those skilled at setting up tents that minor variations will occur with respect to the vertical orientation of the front support and the outward cant of the rear arch among different users and even for the same user, and that although true vertical for the front support and a twelve degree outward cant for the rear arch are the ideal, variations due to "eyeballing" the shelter setup in real life conditions will occur. The shelter will be most taut and weather-worthy when the ideal is achieved on setup.

Referring to FIGS. 1, 2 and 4, front awning 20 can be a partial awning as shown in solid lines, or can be extended to be coextensive with the front edge 14*a* of the canopy as shown in phantom in FIGS. 1 and 4. Illustrated awning 20 is a non-structural part of the canopy, providing weather protection for the front door of the shelter but not forming part of the tensioned canopy structure. In the illustrated embodiment, front awning 20 is attached to the front edge of the canopy on one side of pole 22 (the left side in FIG. 2), for example by sewing. On the other side it is preferably removably attached to the front edge of the canopy, for example with strips of hook-and-loop closure 20*a* located on the underside of the awning and on the upper side of the canopy edge. In fair weather the awning can be detached from the canopy on one side and rolled up on the other, secured for example with tie-offs 20*b* in known fashion.

To prevent flapping in high winds, the front point of the awning can be tensioned to guyline 24, for example with a short length of elastic cord 20*c* extending from the awning edge to a clip connection with a loop 24*a* in the guyline.

Figure 5:
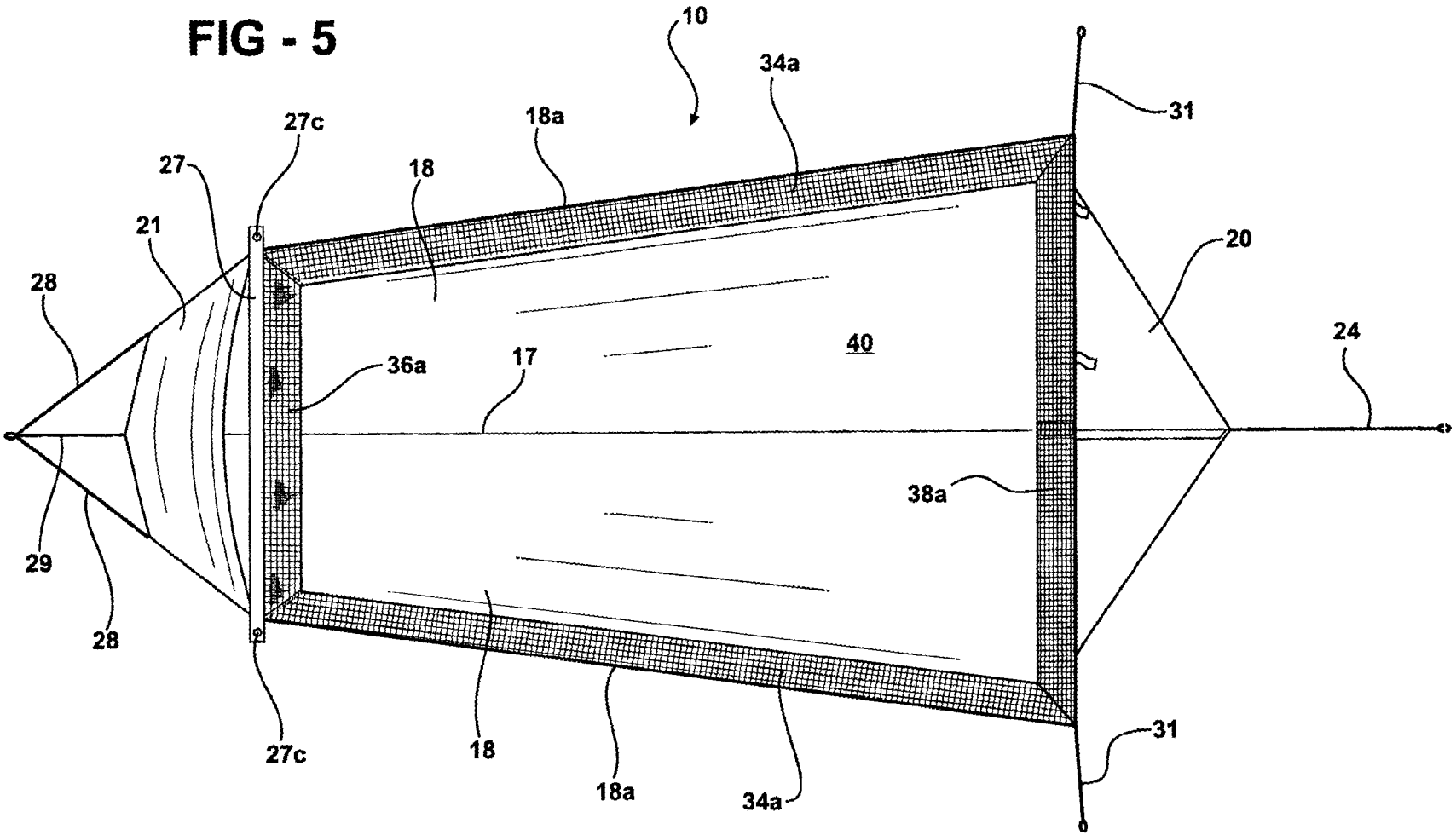
FIG. 5 is a bottom plan view of the shelter of FIG. 1.

Referring next to FIG. 5, the netting perimeter of shelter 10 is shown in a preferred floorless version of the shelter, where the drop down netting is sufficiently long for several inches or more to be extended inwardly toward the open sleeping area 40 as horizontal ground flaps 34*a*, 36*a*, 38*a*. The ends of netting sidewall panels 34 and rear and front end panels 36 and 38 are sewn or otherwise joined at their ends at the corners of the shelter to create a full netting perimeter around the lower edge of the canopy. The corners of the netting make a convenient place to put rocks or gear to weight the netting down. People using the shelter can place their sleeping gear directly on the ground in area 40, or can use a removable groundsheet in sleeping area 40 overlapping the netting ground flaps 34*a*, 36*a*, and 38*a*, or can request that an optional floor be added between the flaps during manufacturing.

An optional floor can simply be attached to the netting perimeter, for example by sewing to sides 34*a* and rear flap 36*a*. However, a floor attached in such fashion can place considerable stress on the netting, and tends to bunch as people move around in the shelter. This problem is solved in the illustrated embodiment with floor-ready attachment structure that can be supplied unobtrusively on a standard floorless shelter but readily receives an optional floor.

Figure 6:
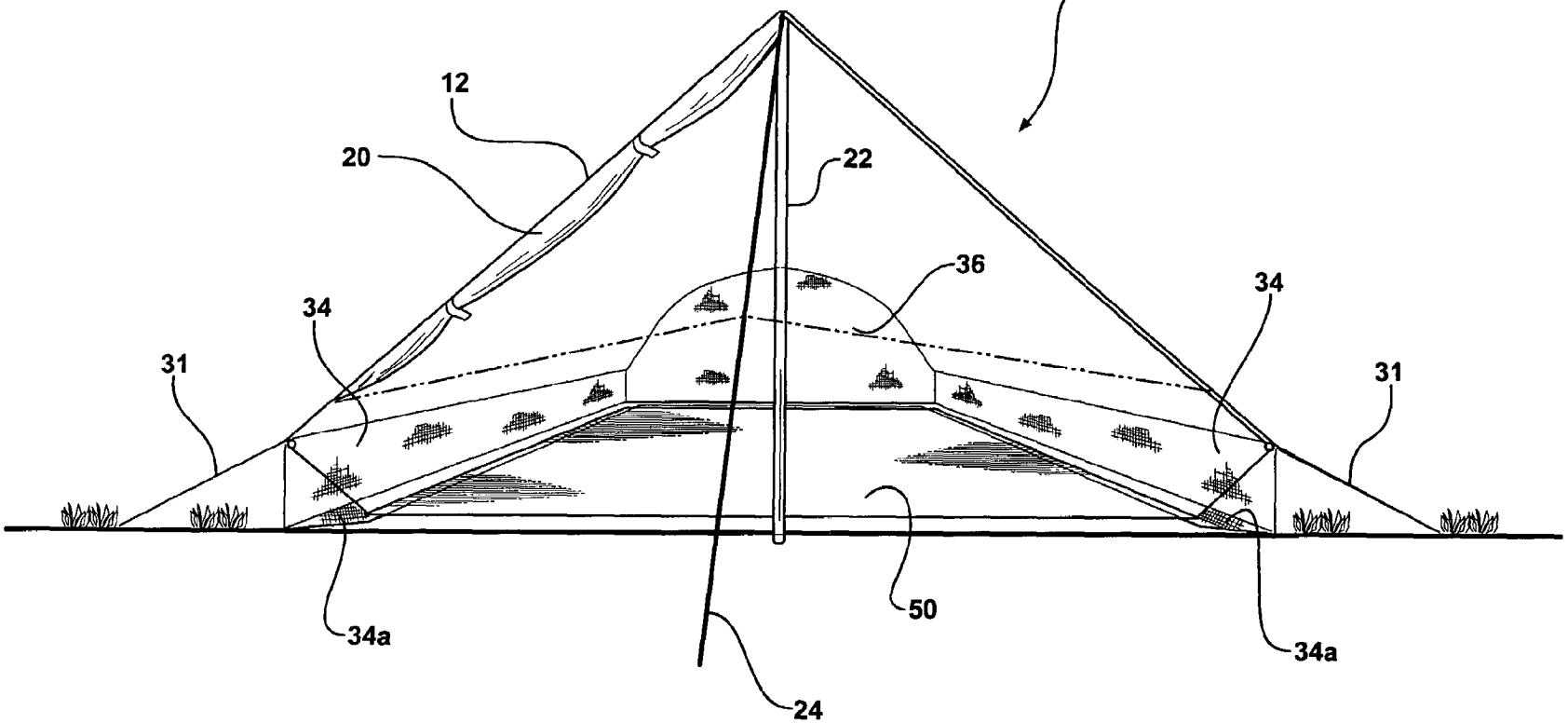
FIG. 6 is a front perspective view of the interior of the shelter of FIG. 1 with a floor added.
Figure 6A:
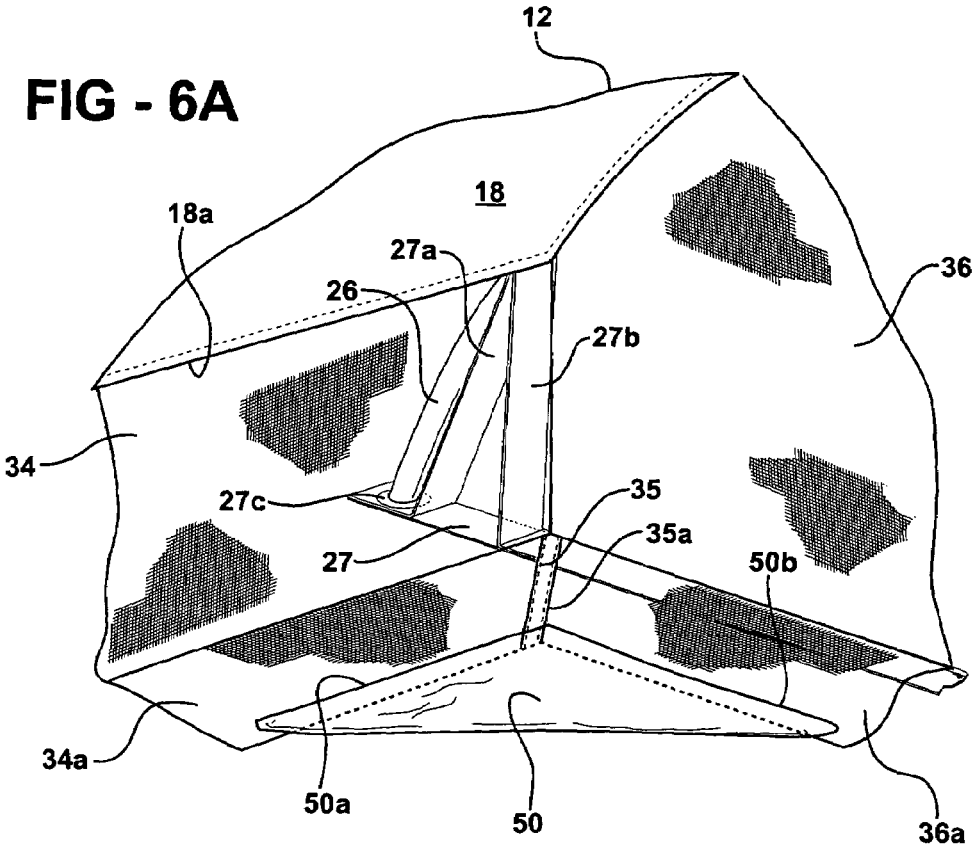
FIG. 6A is a perspective view of an interior rear corner of the shelter of FIG. 1, showing details of a floor attachment structure.

Referring to FIGS. 6 and 6A, the rear corner netting seams 35 are provided with a reinforcement 35*a*, preferably in the form of a strip of flat nylon webbing sewn to the netting, connected to lateral tension strap 27 at one end and with the other end available to be attached (for example by sewing) to the corner of an attached floor 50 at the inside edge of the netting. Reinforcement 35*a* connects the floor to strap 27, which is part of the arch support structure, to isolate stress on the floor both from the relatively delicate netting and from the tensioned canopy. The floor side edges 50*a* and rear edge 50*b* are sewn directly to the netting flaps 34*a* and 36*a*.

Figure 6B:
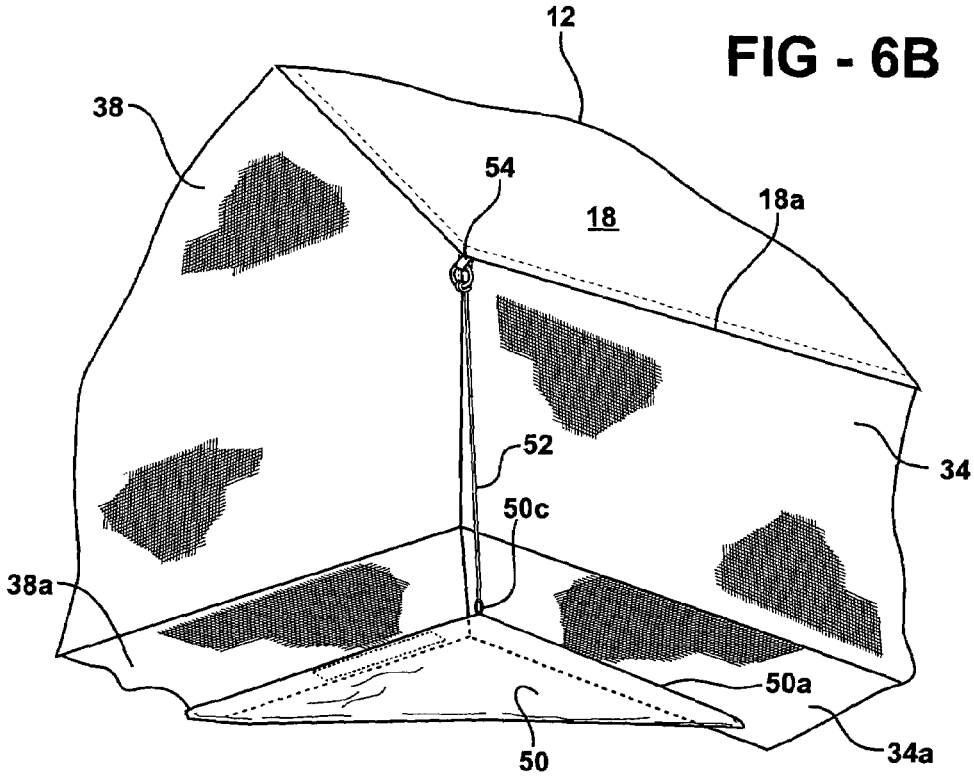
FIG. 6B is a perspective view of an interior front corner of the shelter of FIG. 1, showing details of floor attachment structure.

Referring to FIGS. 6 and 6B, the front corners of the floor are connected at 50*c* with elastic cords 52 to loops 54 or other convenient connection points at the forward raised corners of the canopy above the netting. The use of an elastic attachment for the forward part of the floor is preferred, tensioning the floor forwardly to reduce bunching of the floor as people use the shelter. In the illustrated embodiment, elastic cords 52 are attached to canopy 12 at or near the points where the forward corners of the canopy are guyed out, thereby transferring forces on the floor to the guyline and minimizing stress on the canopy.

If a shelter with the above-described floor-ready attachment structure never receives a floor, elastic cord 52 can simply be omitted or removed, while reinforcements 35*a* in the rear corners help hold the netting down and give some shape to the corners.

Figure 7:
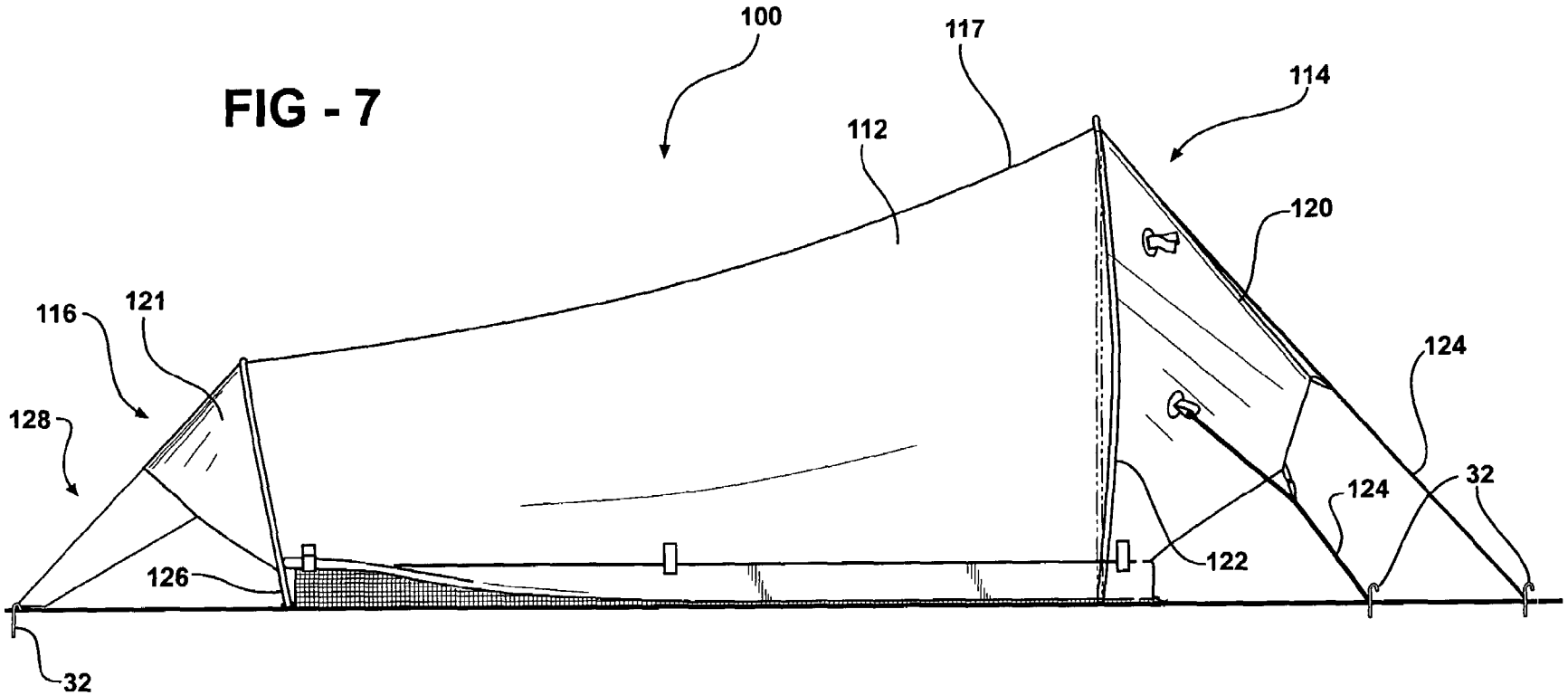
FIG. 7 is a side elevation view of an alternate shelter according to the invention, where the front support is an arch.
Figure 8:
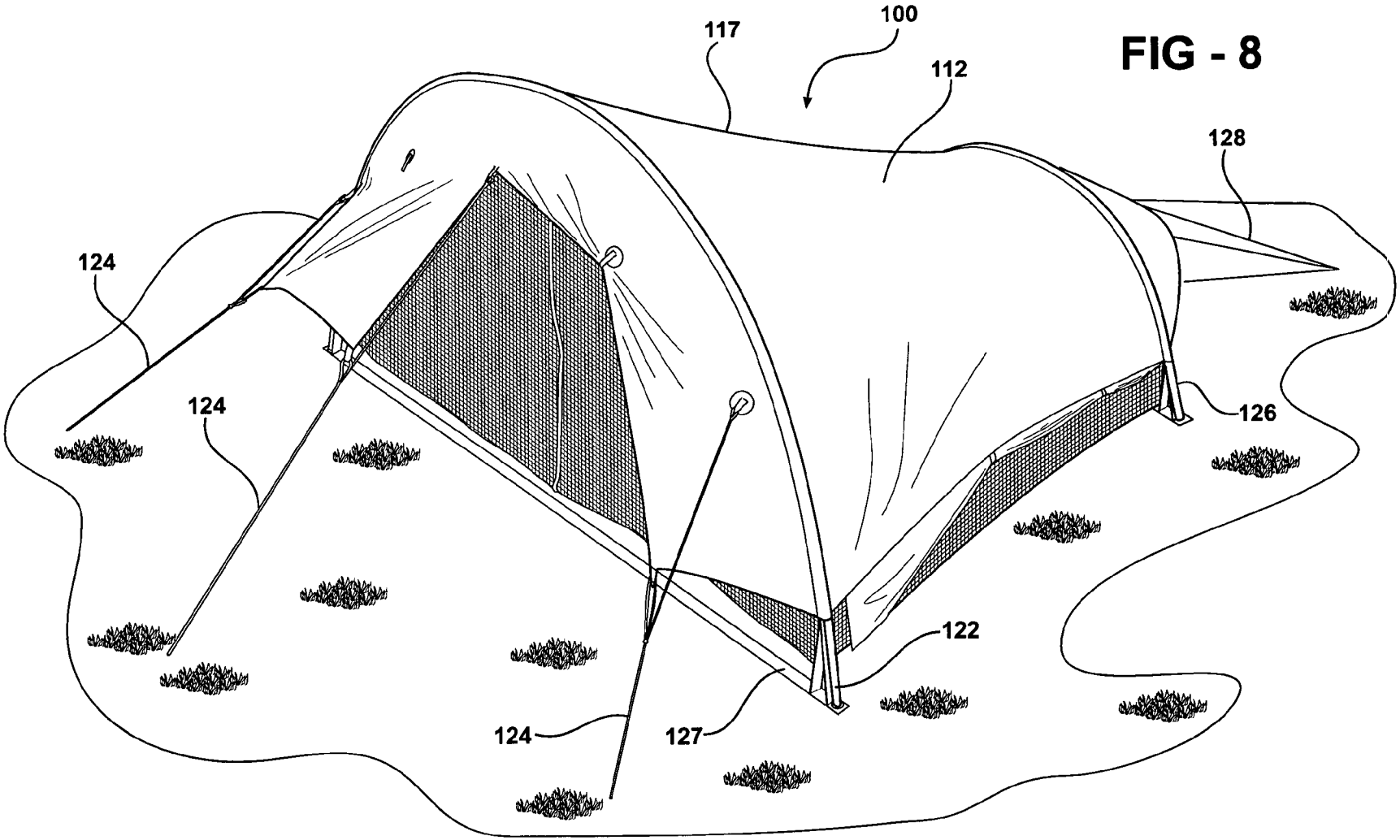
FIG. 8 is a front perspective view of the shelter of FIG. 7.

Referring next to FIGS. 7 and 8, an alternate embodiment of a shelter according to the invention is generally illustrated at 100, with a raised, tensioned canopy 112 having both front and rear ends 114 and 116 supported and structured by arched poles 122 and 126 in a manner similar to that described above for the rear arched end of shelter 10. It is preferred that the rear end 116 of shelter 100 is structurally identical to rear end 14 of shelter 10, including the guyline and staking arrangement. Front end 114, however, uses a larger arch, a vertical arch orientation, and a more weather-resistant and versatile awning structure.

Like canopy 12 in shelter 10, the front end 114 of canopy 112 in shelter 100 is raised and tensioned at the forward end of a catenary ridgeline 117 on a vertical support (pole 122), and the rear end 116 of the canopy is raised and tensioned on a lower, outwardly-angled cantilevered arch support (pole 126). Canopy tension and structure are maintained by guying out the front and rear arch support poles 122 and 126, in the illustrated embodiment through a front awning 120 with spaced parallel guylines 124, and through rear awning 121 with a three-to-one converging guyline structure 128 at the rear. The need for a stakeout point or guyline at the front corners of canopy 112 is eliminated. The guylines are preferably secured to the ground with stakes 32, although they can also be secured to shrubs, trees, rocks and other available anchor points in known manner.

Because the front arched end 114 of shelter 100 includes a lateral tension strap 127 anchoring the ends of arch pole 122 similar to the rear strap and arch structure described above, the forward corner seams of the netting panels can be reinforced and anchored to strap 127 near the pole ends in the same manner as rear corner netting seams 35 in FIGS. 6A and 6B. Forward-tensioning structure such as elastic cord 52 and loops 54 can still be used, but is less necessary to prevent bunching of the floor when the forward end of the floor is anchored to the forward arch strap 127.

It will be apparent to those skilled in the art that the foregoing preferred embodiments of a shelter according to the invention are examples only, and that shelters within the scope of the invention as defined by the claims below may vary in their construction details, materials, dimensions and other respects and equivalents from these examples that I have used to disclose the invention.

I accordingly claim:

1. An improved structure for a nominally floorless hikers' shelter having a raised, tensioned waterproof canopy supported off the ground at a front end and at a rear end, comprising:

a shelter canopy having a catenary ridgeline tensioned between a higher, vertical front support and front canopy edge defining a vertical front door, and a lower, outwardly-cantilevered rear arch support and rear canopy edge defining a screened but otherwise unprotected outwardly-angled rear opening, wherein the rear arch support is tensioned by a downwardly-angled rear awning that forms a tensioned extension of the canopy through the rear arch support, the rear awning being coextensive with the canopy at the rear arch support, the rear awning extending downwardly and rearwardly at an acute angle relative to the rear arch support to a lower edge raised off the ground when the shelter canopy is raised off the ground, the rear awning being exclusive weather protection for the rear opening.

2. The shelter structure of claim 1, wherein the vertical front support comprises a vertical straight pole supporting a central peak point of the front canopy edge in an A-frame configuration.

3. The shelter structure of claim 1, wherein the vertical front support comprises a vertical arch pole supporting the front canopy edge in an arch configuration.

4. The shelter structure of claim 1, wherein the side edges of the shelter canopy are straight.

5. The shelter structure of claim 1, wherein the shelter canopy has an insect netting perimeter hanging from front, rear, and side edges of the canopy and defining a nominally floorless area under the canopy.

6. The shelter structure of claim 1, wherein the canopy includes a front awning extending from the front end of the canopy beyond the vertical front support, the front awning angled downwardly at an acute angle to the vertical front support.

7. An improved structure for a nominally floorless hikers' shelter having a raised, tensioned waterproof canopy supported off the ground at a front end and at a rear end, comprising:

a shelter canopy having a catenary ridgeline tensioned between a higher, vertical front support and a lower, outwardly-cantilevered rear arch support, wherein the shelter canopy has an insect netting perimeter hanging from front, rear, and side edges of the canopy and defining a nominally floorless area under the canopy, and wherein a reinforced floor attachment structure is secured to the rear arch support, and a rear portion of the insect netting is secured to the reinforced floor attachment structure.

8. The shelter structure of claim 7, wherein an elastic floor attachment structure is secured to a front portion of the canopy to be coupled to a forward portion of an optional floor.

9. The shelter structure of claim 7, wherein a reinforced floor attachment structure is secured to the front support, and a forward portion of the insect netting is secured to the reinforced floor attachment.

10. An improved structure for a nominally floorless hikers' shelter having a raised, tensioned waterproof canopy supported off the ground at a front end and at a rear end, comprising:

a shelter canopy comprising a front support at a front entry end and a lower rear arch support, wherein the front support is tensioned by one or more guylines, and the rear arch support is tensioned by rear arch support guylines comprising two outer lines and one central line, the outer lines formed by the ends of a single outer cord secured to opposing sides of the arch support and bisected by the central line, wherein the central line is slidably connected to the outer cord, and wherein the central line has a length greater than a maximum extended distance of the outer cord from the rear arch support, such that an intermediate portion of the central line can be staked rearwardly of the outer cord to simultaneously stake and tension all of the rear arch support guylines.

* * * * *